US008561554B2

(12) United States Patent
Takashima et al.

(10) Patent No.: US 8,561,554 B2
(45) Date of Patent: Oct. 22, 2013

(54) BURNER STRUCTURE

(75) Inventors: Ryuhei Takashima, Nagasaki (JP); Takuichiro Daimaru, Nagasaki (JP); Shinya Hamasaki, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 259 days.

(21) Appl. No.: 12/809,302

(22) PCT Filed: Jul. 24, 2008

(86) PCT No.: PCT/JP2008/063240

§ 371 (c)(1),
(2), (4) Date: Apr. 15, 2011

(87) PCT Pub. No.: WO2009/087787

PCT Pub. Date: Jul. 16, 2009

(65) Prior Publication Data

US 2011/0185952 A1 Aug. 4, 2011

(30) Foreign Application Priority Data

Jan. 8, 2008 (JP) ..... 2008-001342

(51) Int. Cl.
*F23L 5/00* (2006.01)

(52) U.S. Cl.
USPC ..... 110/182.5; 110/347; 110/188; 110/260; 110/262; 110/264; 110/265

(58) Field of Classification Search
USPC ..... 110/188, 260, 262, 264, 265, 182.5, 110/347
See application file for complete search history.

(56) References Cited

U.S. PATENT DOCUMENTS

| | | | | |
|---|---|---|---|---|
| 5,533,329 | A * | 7/1996 | Ohyama et al. | 60/773 |
| 5,806,443 | A * | 9/1998 | Kobayashi et al. | 110/262 |
| 6,085,673 | A * | 7/2000 | Bakker et al. | 110/343 |
| 6,145,450 | A * | 11/2000 | Vatsky | 110/265 |

FOREIGN PATENT DOCUMENTS

| | | | |
|---|---|---|---|
| CN | 85105132 | A | 12/1986 |
| CN | 1518654 | A | 8/2004 |
| DE | 1451582 | A1 | 7/1969 |
| JP | 7-12310 | A | 1/1995 |

(Continued)

OTHER PUBLICATIONS

International Search Report of PCT/JP2008/063240, mailing date Aug. 19, 2008.

Notice of Allowance dated Jun. 14, 2012, issued in corresponding Indonesian Patent Application No. W00201002298, with Partial translation (4 pages).

(Continued)

*Primary Examiner* — Kenneth Rinehart
*Assistant Examiner* — Gajanan Prabhu
(74) *Attorney, Agent, or Firm* — Westerman, Hattori, Daniels & Adrian, LLP

(57) ABSTRACT

To provide a burner structure in which a burner is capable of highly precisely controlling the flow rate of the air for combustion within itself. An air flow passage (11) in a wind box (12) for injecting the air for combustion into a furnace (1) has a bent portion (13) just before joining with the furnace, and one or a plurality of guide vanes (14) are provided in the air flow passage (11) in the bent portion (13), and also in the bent portion (13), a drift control damper (16) is provided for varying the ratio of flow passage resistances of each of the air flow passages (11) divided by the guide vanes (14).

5 Claims, 4 Drawing Sheets

(56) References Cited

FOREIGN PATENT DOCUMENTS

| | | | |
|---|---|---|---|
| JP | 8-178210 | A | 7/1996 |
| JP | 9-133345 | A | 5/1997 |
| JP | 11-338548 | A | 12/1999 |
| JP | 2004-205129 | A | 7/2004 |
| RU | 2055268 | C1 | 2/1996 |
| SU | 334439 | | 4/1972 |
| SU | 1134844 | A1 | 1/1985 |
| SU | 1153183 | A1 | 4/1985 |
| SU | 1802266 | A1 | 3/1993 |
| TW | 482275 | U | 4/2002 |

OTHER PUBLICATIONS

Taiwanese Office Action dated Jul. 7, 2011, issued in corresponding Taiwanese Patent Application No. 097128238.

Russian Office Action dated Jun. 24, 2011, issued in corresponding Russian Patent Application No. 2010126732/06.

Notice of Allowance dated Feb. 19, 2013, issued in corresponding Chilean Patent Application No. 2198-2008.

Notification and Grant of Patent Right for Invention for corresponding Chinese Patent Application No. 200880124101.2 issued on May 15, 2013.

* cited by examiner

BURNER STRUCTURE

TECHNICAL FIELD

This invention relates to a burner structure for a boiler adapted for various kinds of fuels.

BACKGROUND ART

In recent years there has been demand for boilers for burning coals or heavy oils which redress the imbalance in the distribution of the air and the fuel fed to the burner, in order to decrease NOx and carbon monoxide (CO).

FIG. 3 is a horizontal sectional view illustrating a burner structure of a boiler. In this conventional structure, the burner 10 is a device for injecting the fuel and the air for combustion into a furnace 1 in the boiler. In FIG. 3, reference numeral 2 denotes a wall surface of the furnace, and reference numeral 3 denotes a water-cooled wall formed on the wall surface 2 of the furnace on the side toward the furnace. The burner 10 that is shown is disposed at a corner of the boiler.

The burner 10 includes a wind box 12 forming an air flow passage 11 for injecting the air for combustion into the furnace 1, and a fuel pipe 20 for injecting the fuel into the furnace 1. A fuel nozzle 21 is provided at the tip of the fuel pipe 20. An air nozzle 22 which communicates with the air flow passage 11 in the wind box 12 is provided around the outer circumference of the fuel nozzle 21. A fuel such as coal or heavy oil together with primary air is ejected from the fuel nozzle 21. Secondary air (air for combustion) is ejected from the air nozzle 22.

Due to limitations imposed on the arrangement and passage in order to downsize the boiler, the air flow passage 11 formed in the wind box 12, in many cases, has a bent portion 13 that is, usually, greatly bent by not less than 90° just before joining with the furnace 1. In the bent portion 13, separation and drift occurs in the stream of the air for combustion. Therefore, a structure has been employed in which a guide vane 14 is disposed in the air flow passage 11 in the wind box 12 in order to prevent the separation and drift. Reference numeral 15 in FIG. 3 denotes a damper provided in front (upstream) of the guide vane 14 to adjust the flow rate of the air for combustion.

In conventional art related to combustion in boilers, disparity among burner ports or among air inject ports is reduced, or conversely, the bias is reinforced (e.g., see patent citation 1).

Patent Citation 1: Japanese Unexamined Patent Application, Publication No. 7-12310

DISCLOSURE OF INVENTION

In the burner of the above conventional structure, the guide vane 14 is provided in the bent portion 13 in, the air flow passage 11 to prevent the separation and drift of the air for combustion. However, though the guide vane 14 has a function of preventing the separation, it is not capable of completely eliminating the air drift (imbalance in the flow rate of the air measured at various points along the width of the furnace) at the burner outlet portion.

More specifically, the air stream that has passed through the bent portion 13 has its velocity of flow increased on the outer side of the flow passage due to centrifugal force and the like. Therefore, the air for combustion injected into the furnace 1 from the burner outlet develops a velocity of flow which is different at different points along the width (in the right-and-left direction) of the furnace as shown, for example, in FIG. 4(*a*). That is, the air for combustion that has flowed on the outer side of the bent portion 13 flows into the furnace 1 at the right side in FIG. 3. Therefore, the velocity of flow becomes higher on the upper (right) side than on the lower (left) side along the width of the furnace in FIG. 4(*a*). As a result, the amount of CO generated is increased at the lower (left) side along the width of the furnace where the air for combustion becomes deficient.

In the burner 10 having the bent portion 13 as described above, the amounts of CO and volatile organic compounds (VOCs) generated tend to increase in the region on the lower (left) side along the width of the furnace where the amount of air for combustion is scarce as shown in, for example, FIG. 4(*b*), due to imbalance in the amount of the air for combustion between the right side and the left side. With the conventional burner 10, however, the relative amounts of the air for combustion on the right and left sides of the burner outlet portion could not be adjusted.

According to the prior art, combustion in a boiler may be improved by reducing disparity among the plurality of burner ports and air injection ports or by reinforcing the bias. However, no technology has been proposed yet related to reduction of disparity in the flow rate relying upon the burner itself. That is, no prior art has ever been proposed aimed at eliminating the air drift or imbalance that occurs within one burner 10. In order to comply with strict regulations against the CO and VOCs in the future, therefore, there is a demand for higher precision control of the flow of the air for combustion within one burner.

This invention was accomplished in view of the above circumstances, and its object is to provide a burner structure which is capable of higher precision control of the flow of the air for combustion within one burner. Another object of the invention is to provide a countermeasure for preventing slagging in a highly combustible furnace, by effectively using in a reverse manner the control function of the above burner which is capable of precisely controlling its own flow rate of the air for combustion.

The invention is concerned with a burner structure of a boiler in which an air flow passage in a wind box for injecting the air for combustion into a furnace has a bent portion just before the furnace, and one or a plurality of guide vanes in the air flow passage in the bent portion, wherein drift control parts are provided for varying the flow passage resistance ratio of each of the air flow passages divided by the guide vanes.

The above burner structure is provided with drift control parts for varying the flow passage resistance ratio of each of the air flow passages divided by the guide vanes. Upon suitably adjusting the flow rate resistance of the air flow passages, imbalance in the velocity of air flow (flow rate of the air) at the burner outlet can be eliminated or decreased.

In the above invention, it is desired that the drift control part is a drift control damper provided in all of the air flow passages except one, downstream of a damper that controls the flow rate of the air for combustion. Upon adjusting the opening degree of the drift control damper, the flow passage resistance in an air flow passage can be varied. Therefore, the flow rate resistance in the air flow passages can be suitably adjusted. Upon adjusting the opening degree of the drift control damper, therefore, imbalance in the velocity of air flow (flow rate of the air) at the burner outlet can be eliminated or decreased.

In the above invention, it is desired that a sensor is provided for each of the air flow passages to detect the flow (flow rate or velocity of flow) of the air for combustion near the fuel pipe provided in the wind box, and the flow passage resistance ratio is controlled depending upon the value detected by the sensor. According to this constitution, the flow passage resistances in the air flow passages are adjusted depending upon the actual flow detected in each of the air flow passages, and the velocity of air flow (flow rate of the air) can be correctly optimized.

In the above invention, it is desired that when a highly slagging fuel or a corrosive fuel is being used, the flow passage resistance ratio is controlled so that the flow passage resistance is less in the flow passage by the wall surface of the furnace. According to this constitution, the flow rate of the air can be increased near the wall surface closer to the furnace. The corrosive fuel, in this case, is a fuel having a large sulfur content. The oxygen concentration increases with increase in the flow rate of the air near the wall surface closer to the furnace. Therefore, a reducing atmosphere turns into an oxidizing atmosphere, making it possible to decrease the concentration of hydrogen sulfide which is a cause of corrosion.

According to the invention as described above, since a drift control part such as a drift control damper for varying the flow passage resistance in each of the air flow passages is provided, imbalance in the velocity of air flow (flow rate of the air) at the burner outlet of the burner itself can be eliminated or decreased. Therefore, a burner structure capable of highly precisely controlling the flow rate of the air for combustion can be provided.

By using this burner structure capable of very precisely controlling the flow rate of the air for combustion, further, slagging can be prevented in a high combustion furnace even when a highly slagging fuel is used, by increasing the flow rate of the air by the wall surface of the furnace by effectively the control of the flow rate of the air in each burner in a reverse manner. When a corrosive fuel is used, further, the flow rate of the air by the wall surface closer to the furnace is increased in order to lower the concentration of hydrogen sulfide which is a cause of corrosion, effectively preventing corrosion on the wall surface of the furnace.

EXPLANATION OF REFERENCE

Figure 1:
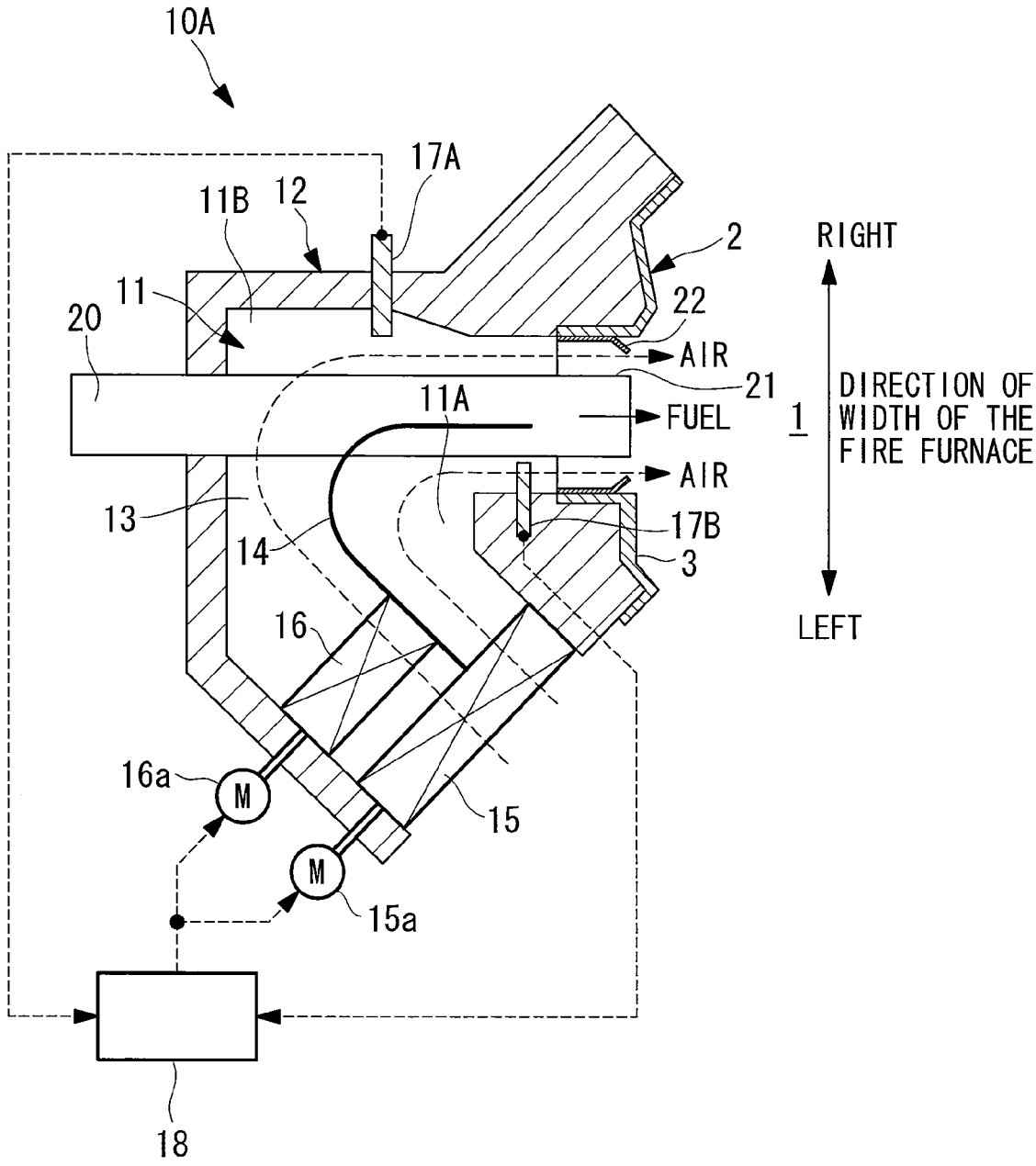
FIG. 1 is a horizontal sectional view illustrating an embodiment of a burner structure according to the invention.

1: furnace
2: wall surface of the furnace
10A: burner
11, 11A, 11B: air flow passages
12: wind box
13: bent portion
14: guide vane
15: damper
16: drift control damper
17A, 17B: sensors
18: control unit

BEST MODE FOR CARRYING OUT THE INVENTION

An embodiment of the burner structure according to the invention will now be described with reference to the drawings.

In the burner structure of a boiler shown in FIG. 1, a burner 10A mounted on the boiler, that burns coal or heavy oil, is a device that injects the fuel and the air for combustion into a furnace 1 to burn them. The burner 10A that is shown is disposed, for example, at a corner of the boiler. In the drawing, reference numeral 2 denotes a wall surface of the furnace, and 3 denotes a water-cooled wall formed on the side of the wall surface 2 of the furnace facing toward the furnace.

The burner 10A includes a wind box 12 forming an air flow passage 11 for injecting the air for combustion into the furnace 1, and a fuel pipe 20 for injecting the fuel into the furnace 1. A fuel nozzle 21 is provided at the tip of the fuel pipe 20. An air nozzle 22 which communicates with the air flow passage 11 in the wind box 12 is provided around the outer circumference of the fuel nozzle 21. A fuel such as coal or heavy oil together with primary air is ejected from the fuel nozzle 21. Secondary air (air for combustion) is ejected from the air nozzle 22.

The air flow passage 11 formed in the wind box 12 is of a shape having a bent portion 13 that is greatly bent by not less than 90° just before joining with the furnace 1. In the bent portion 13, separation and drift occurs in the stream of the air for combustion. Therefore, a guide vane 14 is disposed in the air flow passage 11 in the wind box 12 in order to prevent the separation and drift. In the embodiment that is shown, the bent portion 13 in the air flow passage 11 is divided by the guide vane 14 into two, i.e., inner and outer (left and right) air flow passages 11A and 11B.

Reference numeral 15 in the drawing denotes a damper for adjusting the flow rate of the air for combustion. The damper 15 is disposed in front (upstream) of the guide vane 14 to control the flow rate of all the air fed into the air flow passage 11.

The burner 10A of this embodiment is provided with a drift control damper 16 which is a drift control part for varying the ratio of the flow passage resistances of the air flow passages 11A and 11B divided into two by the guide vane 14.

The drift control damper 16 is provided downstream of the damper 15 that controls the flow rate of the air for combustion. The drift control dampers 16 may be provided in both of the air flow passages 11A and 11B divided into two by the guide vane 14, and the opening degrees of the two dampers may be controlled. However, since only the ratio of the flow passage resistances of the two air flow passages 11A and 11B need be varied, varying the opening degree of only one damper provided in one of the air flow passages provides sufficient control. In the burner 10A that is shown, therefore, of the two air flow passages 11A and 11B divided by the guide vane 14, the air flow passage 11B which is on the outer circumferential (large diameter) side of the flow passage at the bent portion 13 with close to a U-shape is provided with the drift control damper 16 at a position near the inlet of the bent portion 13.

Figure 2:
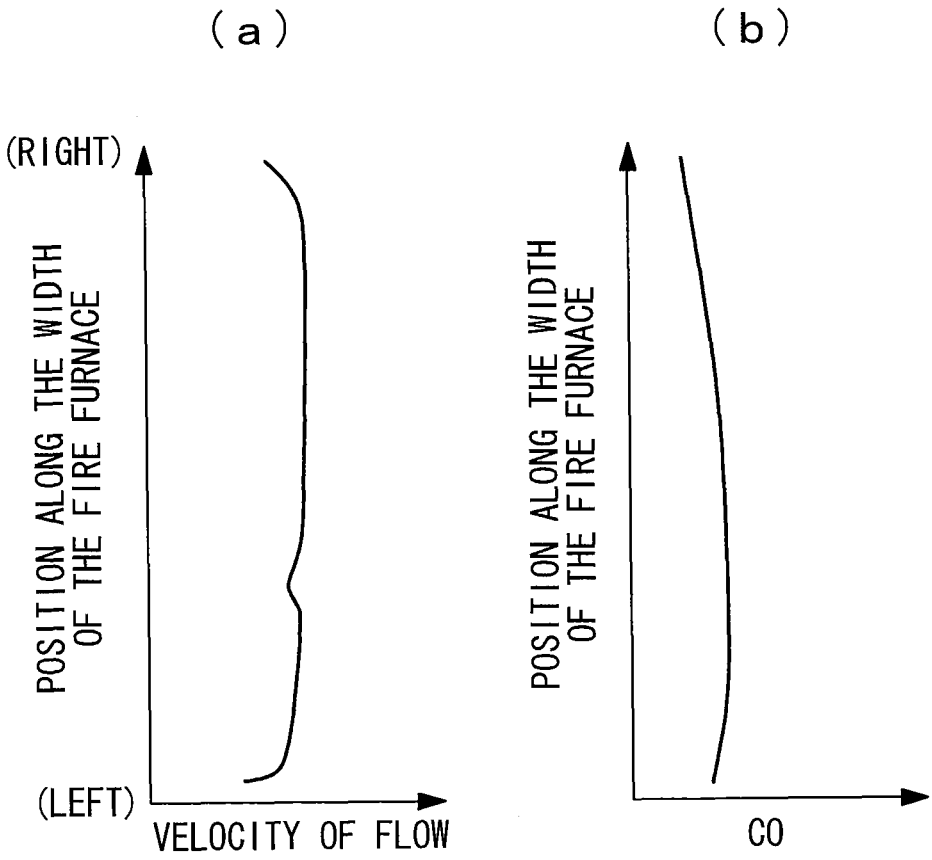
FIG. 2 is a diagram illustrating the action and effect of the burner structure according to the invention, wherein (a) is a diagram of distribution of velocities of flow of the air for combustion near the outlet vs. position along the width of the furnace, and (b) is a diagram of a distribution of CO near the outlet vs. position along the width of the furnace.
Figure 3:
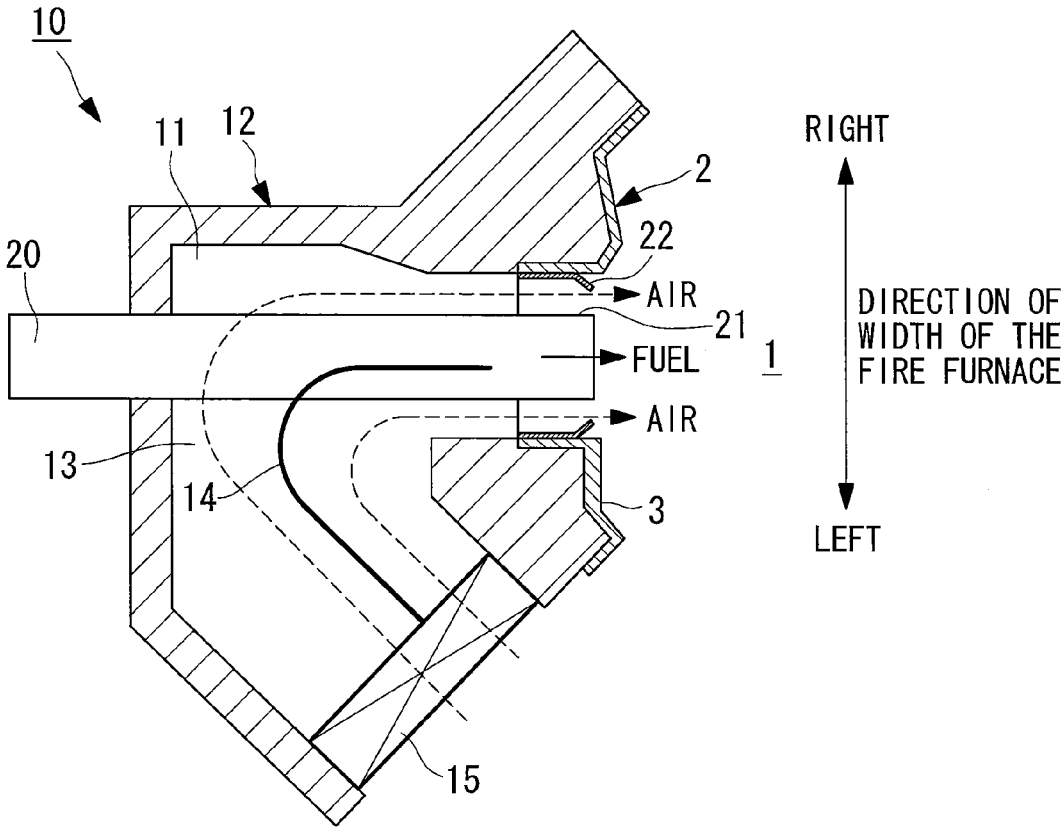
FIG. 3 is a horizontal sectional view illustrating a conventional burner structure.
Figure 4:
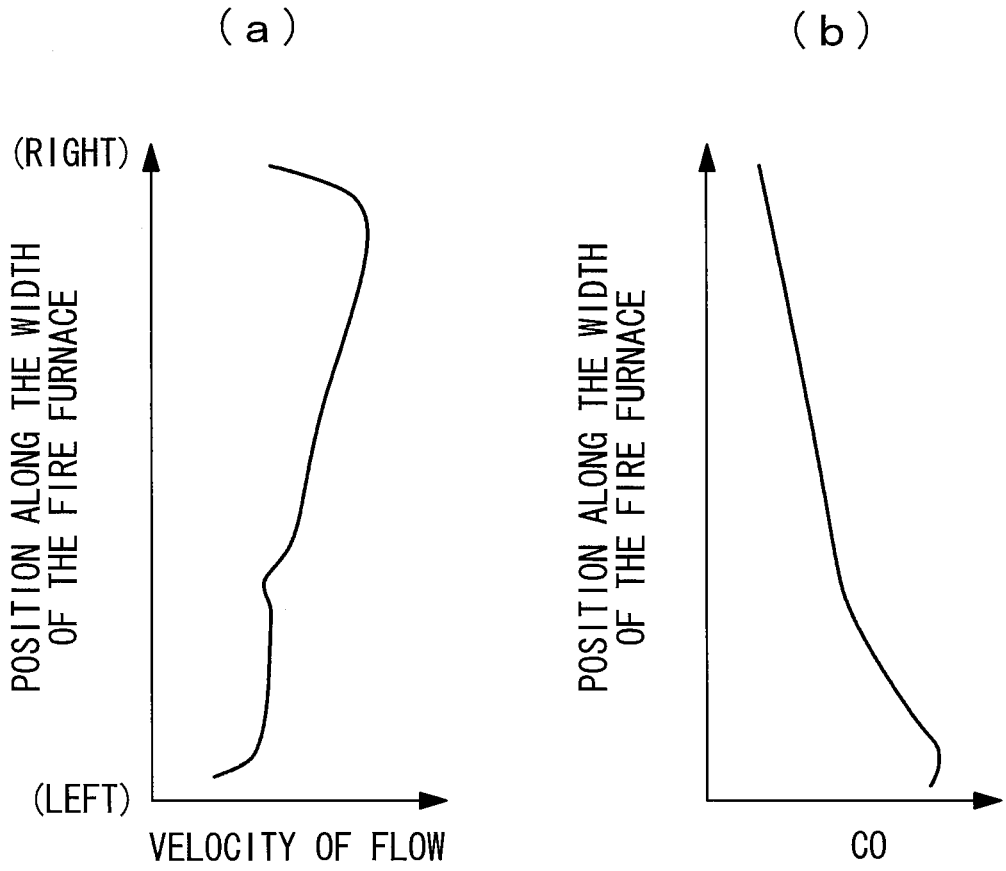
FIG. 4 is a diagram illustrating the action and effect of the burner structure shown in FIG. 3, wherein (a) is a diagram of distribution of velocities of flow of the air for combustion near the outlet vs. position along the width of a furnace, and (b) is a diagram of a distribution of CO near the outlet vs. the position along the width of the furnace.

According to this constitution, the opening degree of the drift control damper 16 provided at the inlet portion of the air flow passage 11B of the bent portion 13 is adjusted, making it possible, as shown in FIG. 2(*a*), to eliminate or decrease imbalance in the flow rate of the air occurring in the air flow passages 11A and 11B as the air flows through the bent portion 13. That is, between the passages divided by the guide vane 14, the velocity of flow and, therefore, the flow rate of the air in the left air flow passage 11B which is on the outer side in the bent portion becomes greater than in the right air flow passage 11A. Therefore, the opening degree of the drift control damper 16 is lessened to increase the flow passage resistance. As a result, the flow passage resistances in the air flow passages 11A and 11B are different, and the velocity of flow and the flow rate of the air for combustion, whose flow rate is controlled by the damper 15, which flows into the air flow passage 11A having relatively low flow passage resistance is increased.

Along the width of the furnace shown in FIGS. 1 and 2, the distance to the wall surface is shorter on the right side.

If the flow passage resistance ratios are varied in the air flow passages 11A and 11B as described above, in the air flow passage 11B where in the conventional structure the velocity of flow and the flow rate increase, the flow path resistance increases and the velocity of flow and the flow rate decreases, whereas in the air flow passage 11A where in the conventional structure the velocity of flow and the flow rate decrease, the flow path resistance decreases and the velocity of flow and the flow rate increase. Upon suitably adjusting the velocity of flow and the flow rate of the air for combustion through the air flow passages 11A and 11B, the air for combustion is made to flow in nearly the same amount through the two flow passages, eliminating imbalance. As shown in FIG. 2(*b*), therefore, the amount of CO generation can be lowered over almost the whole region.

That is, the opening degree of the drift control damper 16 is adjusted to vary the flow passage resistance in the air flow passage 11B. Upon adjusting the opening degree of the drift control damper 16, therefore, the flow passage resistance in the air flow passage 11B varies, making it possible to suitably set the ratio of the flow resistances in the air flow passages 11A and 11B, and therefore to eliminate or decrease an imbalance in the velocity of air flow (flow rate of the air) on the right and left sides of the burner outlet, and further to decrease the amount of CO generation.

The above drift control damper 16 was provided in the air flow passage 11B. The drift control damper 16, however, may be provided in the air flow passage 11A. In this case, the opening degree of the drift control damper 16 is controlled in a direction in which the flow passage resistance decreases in the air flow passage 11A through which the velocity of flow and the flow rate of the air for combustion tend to decrease, to thereby change the flow passage resistance ratio and eliminate or decrease an imbalance in the velocity of air flow (flow rate of the air) between the right and left sides of the burner outlet.

The above embodiment has dealt with the constitution in which the air flow passage 11 was divided into two by the guide vane 14. When the air flow passage 11 is divided into three or more, drift control dampers 16 whose opening degrees can be controlled independently from each other may be provided for each of the divided air flow passages except the innermost air flow passage, and the flow path resistance ratios may be adjusted for each of the divided air flow passages.

In the above burner 10A, further, it is desired to provide sensors 17A and 17B for each of the air flow passages 11A and 11B to detect the flow of the air for combustion near the fuel pipe 20 provided in the wind box 12. These sensors 17A and 17B are for detecting the flow rates or the velocities of flow of the air for combustion.

Detected values such as the flow rates detected by the sensors 17A and 17B are input to a control unit 18 that controls the opening degree of the drift control damper 16. In the embodiment that is shown, the control unit 18 is so constituted as to control the drive motor 16*a* of the drift control damper 16 and the drive motor 15*a* of the damper 15, to which only, however, the invention is not limited.

According to the above constitution, the actual flow of the air for combustion is detected based on the values detected by the sensors 17A and 17B. Then, the flow passage resistance ratios are controlled by adjusting the opening degree of the drift control damper 16 that the detected values will be balanced within a desired range. That is, the actual flows in the air flow passages 11A and 11B are detected separately to more correctly optimize the velocity of air flow or the flow rate of the air.

The above flow passage resistance ratios are such that when a highly slagging fuel such as sub-bituminous coal is used in the burner 10A, the flow passage resistance is decreased in the flow path by the wall surface 2 of the furnace to increase the flow rate of the air by the wall surface 2 of the furnace in order to suppress or prevent the slagging. Also, when a corrosive fuel with large sulfur content is used, the flow passage resistance is decreased in the flow path by the wall surface 2 of the furnace to increase the flow rate of the air by the wall surface 2 of the furnace in order to suppress or prevent the corrosion. That is, in the boiler of the whirl combustion type which is so constituted that the fuel and the air for combustion form a whirling stream and burn as they are injected into the furnace from the burners 10A provided at a plurality of positions along the furnace wall forming a rectangle in cross section, the air for combustion injected from the burners 10A tilted relative to the wall surface 2 of the furnace so that flow is maldistributed, a greater portion distributed to the side of the wall surface 2 of the furnace. An increase in the flow rate of the air means an increase in the amount of oxygen. Therefore, a reducing atmosphere with a high concentration of hydrogen sulfide, which is a cause of corrosion, is turned into an oxidizing atmosphere which will lower the concentration of hydrogen sulfide and thereby prevent corrosion.

As described above, the drift control damper 16 provided for eliminating the above imbalance is operated in reverse to increase the flow the air for combustion by the wall surface 2 of the furnace to effectively prevent slagging.

According to the burner structure of the invention as described above, the drift control damper 16 is provided as a drift control part for varying the ratio of the flow passage resistances of the air flow passages 11. Therefore, an imbalance in the velocity of air flow (flow rate of the air) at the burner outlet of each burner 10A can be eliminated or decreased, and the flow rate of the air for combustion can be very precisely controlled.

Further, by effectively utilizing one of the burners 10A for controlling the flow rate of the air in a reverse fashion, the burner structure capable of highly precisely controlling the flow rate of the air for combustion works to increase the flow rate of the air by the wall surface 2 of the furnace, making it possible to prevent slagging in a high combustion furnace and to prevent corrosion when a corrosive fuel is used.

The invention is not limited to the above embodiment, and can be further suitably modified to the extent that it does not depart from the gist of the invention; for example, arranging the burner at a corner or on a wall surface to reduce disparity between the right side and the left side or make possible prevention of corrosion by operation in the reverse fashion.

The invention claimed is:

1. A burner structure of a boiler comprising:

a single air flow passage for injecting air into a furnace through an air nozzle; and a fuel passage for injecting fuel into the furnace through a fuel nozzle disposed inside the air nozzle, wherein the air flow passage has a bent portion just before the air nozzle, and the bent portion is formed so that a center line of the air flow passage which extends along centroids of cross-sections of the air flow passage is bent at the bent position, wherein a guide vane is provided in the air flow passage, the guide vane formed to extend from an upstream side to a downstream side of the bent portion so that the guide vane divides the air flow passage at the bent portion into two or more divided air flow passages, wherein the air flow passage is provided with a drift control part for varying the ratio of the flow passage resistances of each of the divided air flow passages divided by the guide vanes.

2. The burner structure according to claim 1, wherein the drift control part is a drift control damper provided in all except one of the divided air flow passages, downstream of a damper that controls the flow rate of the air for combustion.

3. The burner structure according to claim 1, further comprising:

a sensor, wherein the sensor is provided in each of the divided air flow passages to detect the flow of the air for combustion near a fuel pipe, and the flow passage resistance ratio is controlled depending upon the values detected by the sensors.

4. The burner structure according to claim 1, wherein when a highly slagging fuel or a corrosive fuel is being used, the flow passage resistance ratio is controlled so that a flow passage resistance of at least one of the divided air flow passage near the wall surface of the furnace decreases.

5. The burner structure according to claim 1, wherein the bent portion is configured so that the center line of the air flow passage is bent by not less than 90° at the bent portion.

* * * * *

UNITED STATES PATENT AND TRADEMARK OFFICE

CERTIFICATE OF CORRECTION

PATENT NO. : 8,561,554 B2
APPLICATION NO. : 12/809302
DATED : October 22, 2013
INVENTOR(S) : Takashima et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 540 days.

Signed and Sealed this
Fifteenth Day of September, 2015

Michelle K. Lee

Michelle K. Lee
*Director of the United States Patent and Trademark Office*